US005396662A

United States Patent [19]

Leonard et al.

[11] Patent Number: 5,396,662

[45] Date of Patent: * Mar. 14, 1995

[54] BIKINI BOTTOM OR BRIEFS

[75] Inventors: Cynthia D. Leonard; Lawrence Gayne, both of North York, Canada

[73] Assignee: L.C.G. Consulting, North York, Canada

[ * ] Notice: The portion of the term of this patent subsequent to Nov. 29, 2011 has been disclaimed.

[21] Appl. No.: 159,137

[22] Filed: Nov. 30, 1993

Related U.S. Application Data

[63] Continuation-in-part of Ser. No. 140,509, Oct. 25, 1993, Pat. No. 5,367,715.

[51] Int. Cl.[6] ..... H41B 9/00

[52] U.S. Cl. ..... 2/401; 2/400; 2/403; 2/406

[58] Field of Search ..... 2/46, 69, 69.5, 75, 2/79, 80, 227, 401, 402, 403, 404, 405, 406, 407, 408; 450/41, 42, 43, 44, 45, 46, 47, 48, 49, 50, 51, 52, 114, 132, 135, 143, 156; 604/393, 385.1

[56] References Cited

U.S. PATENT DOCUMENTS 2,534,934 12/1950 Viniegra ..... 2/67
3,339,208 9/1967 Marbach ..... 2/67
4,394,781 7/1983 Axmann ..... 2/67

*Primary Examiner*—Jeanette E. Chapman
*Attorney, Agent, or Firm*—George A. Seaby

[57] ABSTRACT

A relatively simple frame for use in bikini bottoms or briefs includes two lengths of wire which are bent to define mirror images of each other, the lengths defining a major portion of an oval of sufficient length to extend around the crotch of a wearer between a V-shaped line across the rectus abdominous muscle in the front and the sacrum in the rear of the wearer. Each of the lengths of wire includes a straight, vertical rear portion extending downwardly from an inverted L-shaped top rear end to approximately the bottom center of the crotch area, and a front portion flaring outwardly and upwardly from the vertical plane of the straight rear portion to a top end and then downwardly to the vertical plane of the rear portion. The two lengths of wire are interconnected using conventional cable connectors to define a T-shaped rear and a generally triangular front with a V-shaped depression in the top thereof. A front connector loosely retains the wires so that the frame can readily be deformed during manufacture of the product. The frame is covered with a fabric or other flexible cover.

6 Claims, 5 Drawing Sheets

BIKINI BOTTOM OR BRIEFS

This application is a continuation-in-part of application Ser. No. 08/140,509, filed Oct. 25, 1993, now U.S. Pat. No. 5,367,715.

BACKGROUND OF THE INVENTION

1. Field of the Invention

This invention relates to a bikini bottom or briefs.

More specifically, the invention relates to a frame for a bikini bottom or briefs, and the bikini bottom or briefs produced by covering the frame.

2. Discussion of the Prior Art

In general, bikini bottoms or briefs are formed of a fabric, which is cut and sewn to produce an article of clothing having the desired shape and size. The articles are substantially tubular, including a top opening for the hips or waist of the wearer and a pair of bottom openings for the legs. In the past, such bottoms or briefs have been produced using a resilient frame covered with fabric, the use of a frame beneath the fabric enabling the manufacturer to omit the portions of the article extending around the waist of the wearer. Articles of this type are disclosed for example in U.S. Pat. No. 2,534,934, which issued to F. Viniegra on Dec. 19, 1950; U.S. Pat. No. 3,339,208, which issued to R. L. Marbach on Sep. 5, 1967 and U.S. Pat. No. 4,934,781, which issued to O. Axmann on Jul. 26, 1983, and French Patent No. 2,481,893, which issued to V. O. Denis on Nov. 13, 1981.

In articles of the type in questions, aside from the question of cost, there are two considerations which need be addressed, namely the appearance of the finished product and comfort. In general, devices of the type described in the above listed patents are expensive to produce, uncomfortable or somewhat uninteresting in terms of shape or pattern.

The simplest and virtually only convenient method of covering a wire frame involves the production of a tubular cover which is pulled onto the frame like a sock. When the cover is pulled onto the frame, the latter must be deformed, and if the frame is not sufficiently resilient it will not assume its original shape. Other problems are the fact that the patented articles are not properly supported on the body of the wearer, do not conform to the shape of the tummy of the wearer and/or are unlikely to retain their shape during use. Because existing frames are relatively rigid, they tend to dig into any but the flatest of stomachs.

GENERAL DESCRIPTION OF THE INVENTION

An object of the present invention is to offer a solution to the above-identified problems in the form of a relatively simple yet aesthetically pleasing bikini bottom or briefs, and a frame for producing such an article of manufacture.

Another object of the invention is to provide a frame for a bikini bottom or briefs which is easy to produce and which, while retaining its shape on the wearer, is relatively comfortable, conforming to the shape of the tummy of the wearer.

Accordingly, the present invention relates to a frame for a bikini bottom or briefs comprising a pair of resilient wire members, one said wire member being the mirror image of the other said wire member, each said wire member defining a major portion of an oval of sufficient length to extend around the crotch of a wearer between an approximately V-shaped line on the rectus abdominous muscle in the front and the sacrum in the rear of the wearer, each said member including a rectilinear rear portion for extending downwardly from the top rear of the frame to approximately the bottom center of the crotch area, an outwardly extending rear arm at the top of the rear portion, and a front portion including a side flaring outwardly from the vertical plane of said rectilinear rear portion to a top end and a front arm extending downwardly and inwardly from said top end to said vertical plane; and connector means for interconnecting said frame members to define a T-shaped rear and a generally triangular front, said front having a generally V-shaped depression in the top thereof, said connector means including a first connector pivotally interconnecting the front portions of said frame members, whereby said front of the frame is readily deformed to facilitate mounting of a cover on the frame and to permit the front to conform to the area of the rectus abdominous muscle of the wearer.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

Figure 2:
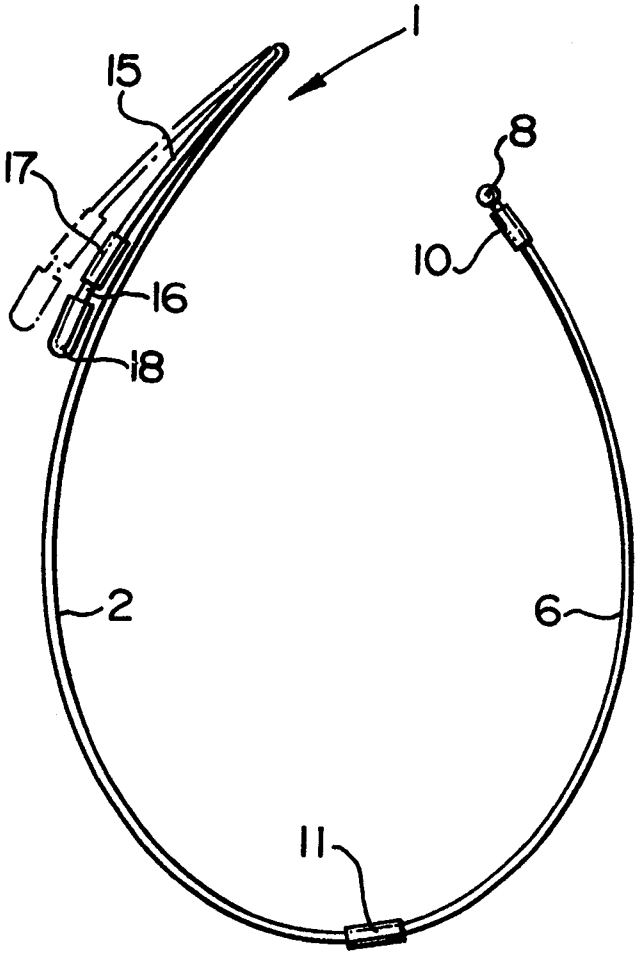
FIG. 2 is a side view of the frame of FIG. 1.
Figure 1:
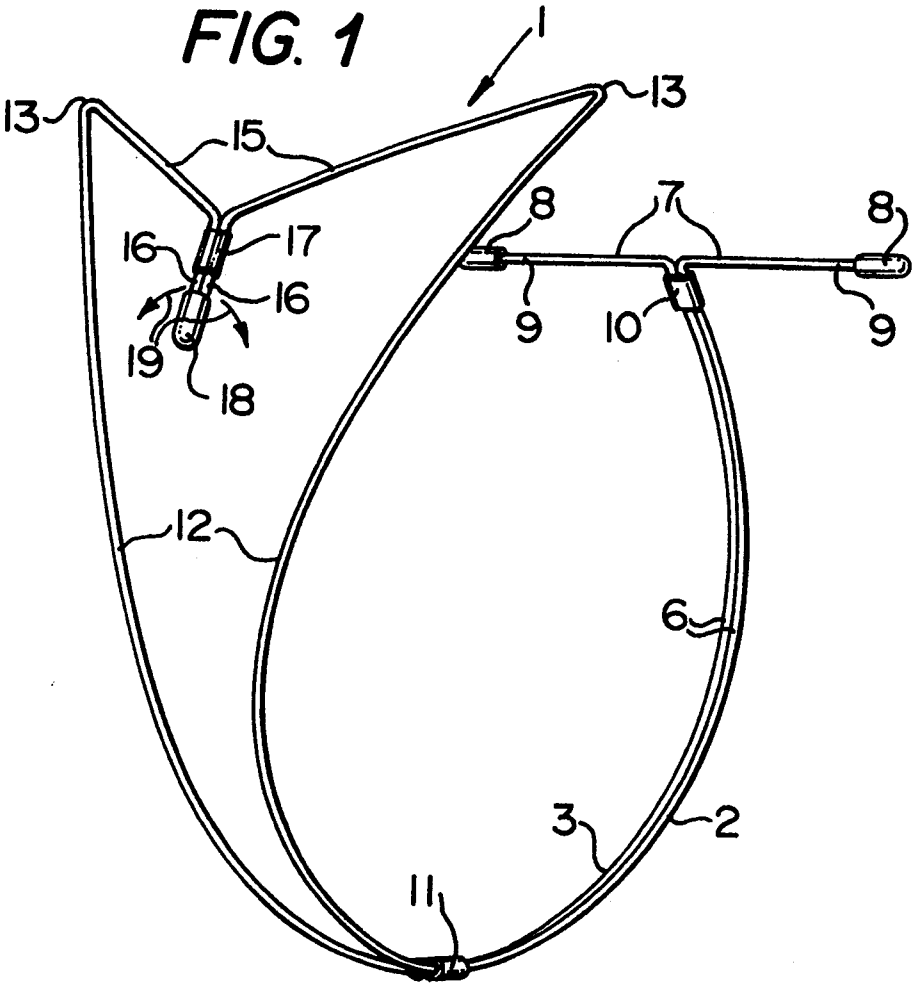
FIG. 1 is a perspective view from the front and one side of a frame for use in a bikini bottom or briefs in accordance with the present invention.
Figure 3:
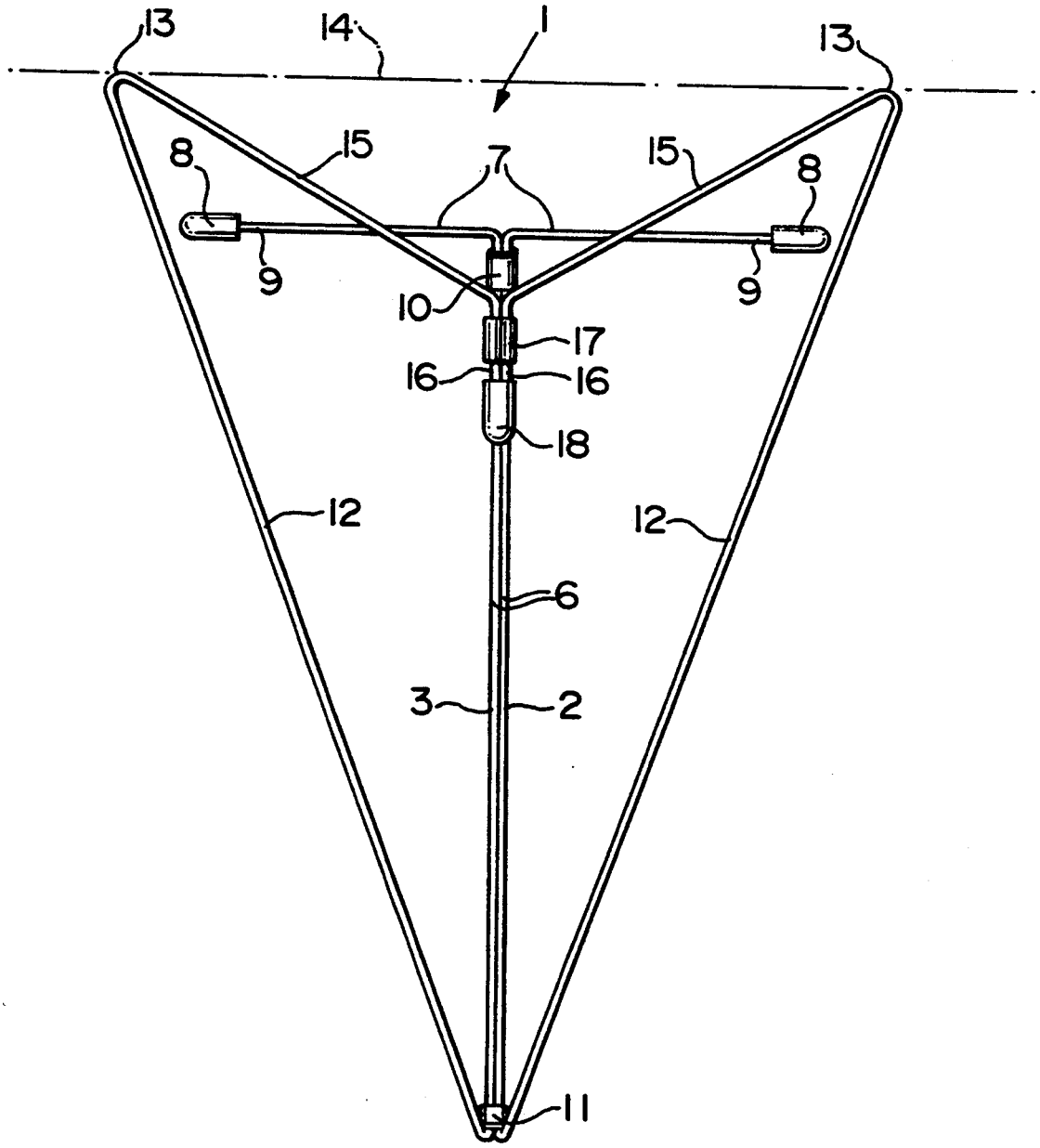
FIG. 3 is a front view of the frame of FIGS. 1 and 2.
Figure 4:
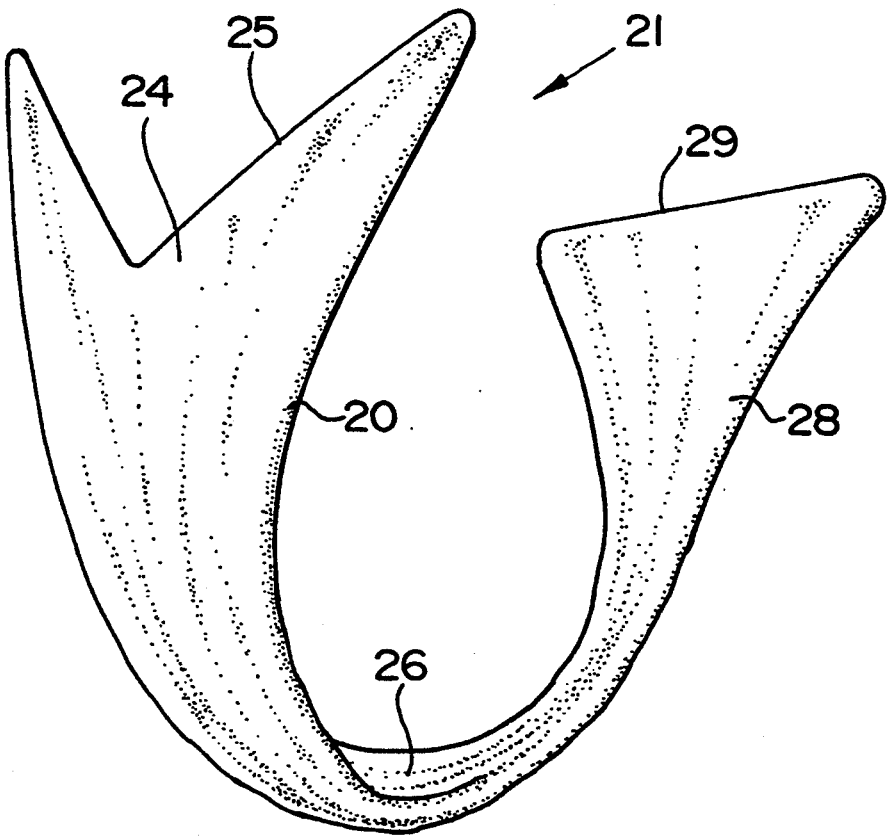
FIG. 4 is a perspective view from the front and one side of a bikini bottom or briefs produced using the frame of FIGS. 1 to 3.
Figure 5:
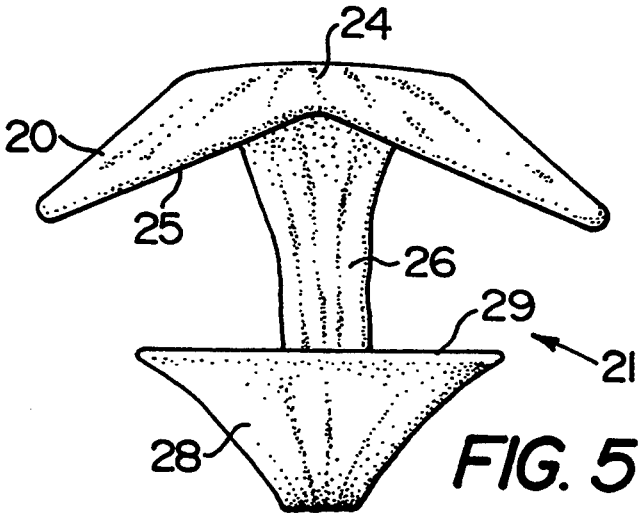
FIG. 5 is a top view of the bottom or briefs of FIG. 4.
Figure 6:
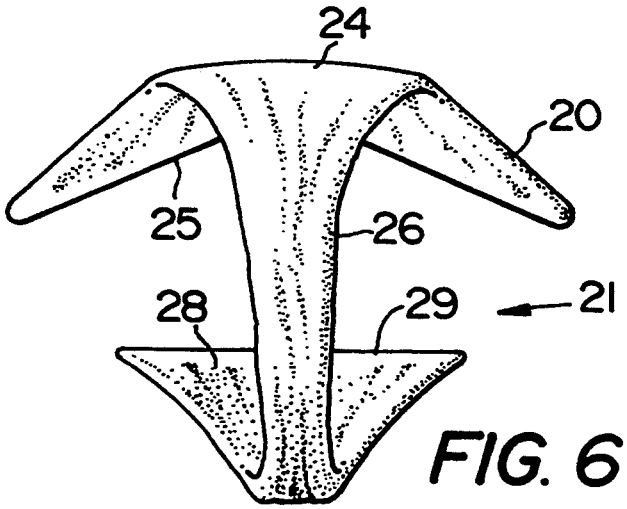
FIG. 6 is a bottom view of the bottom or briefs of FIGS. 4 and 5.
Figure 8:
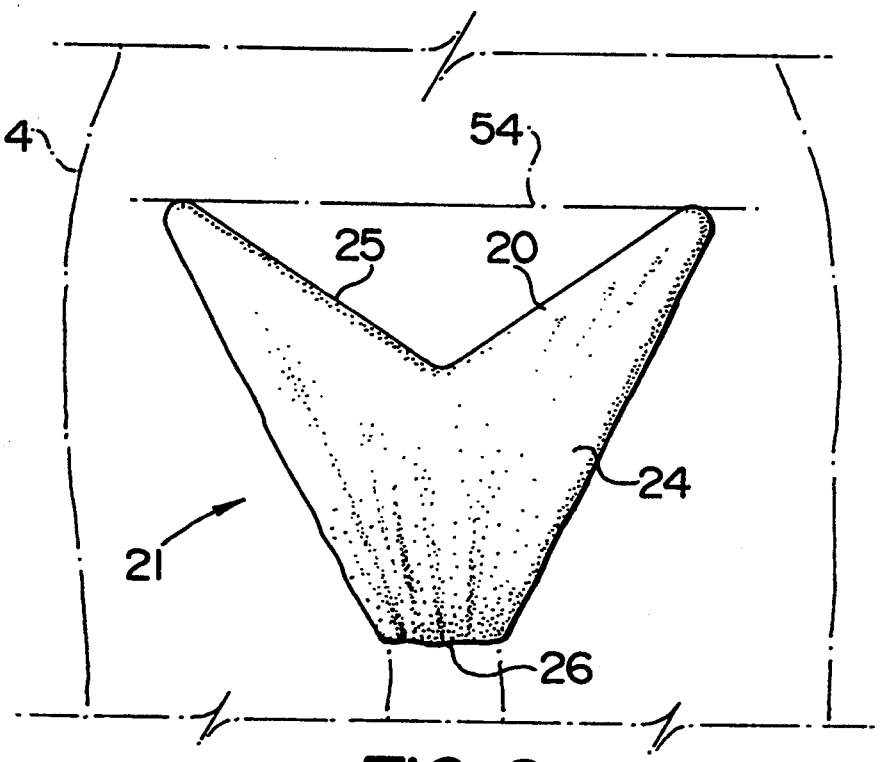
FIG. 8 is a front view of the bottom or briefs of FIGS. 4 to 7.
Figure 9:
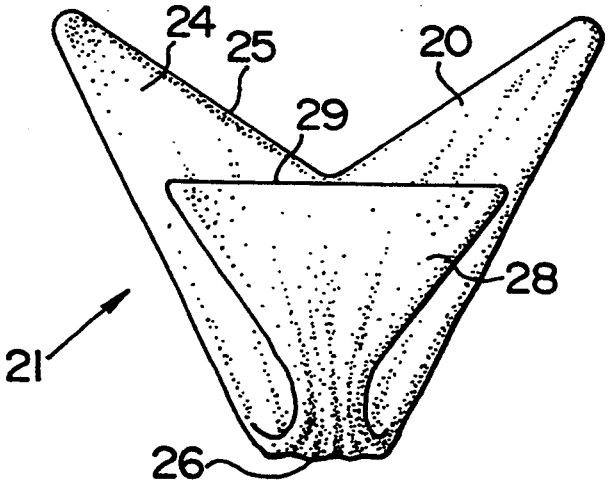
FIG. 9 is a rear view of the bottom or briefs of FIGS. 4 to 8.

With reference to FIGS. 1 to 3, a frame used as a base for the bikini bottoms or briefs of the present invention which is generally indicated at 1 includes a pair of wire members 2 and 3 which are mirror images of each other. Each of the members 2 and 3 includes a single length of wire, which is bent to define a major portion of an oval (FIG. 2) such that if the free ends of the wire were extended to meet, the resulting figure would be more or less drop-shaped. The wire members 2 and 3 are resilient and are intended to extend around the crotch of a wearer 4 (FIG. 8) from above the rectus abdominous muscle in the front to the sacral area in the rear. More specifically, the wire members 2 and 3 extend between a line (FIG. 8) extending approximately between the top of the ilia in the front and the sacrum in the rear of a wearer.

When viewed from the front or the rear, each of the wire members 2 and 3 includes a rectilinear rear portion 6 extending downwardly from an outwardly extending arm 7 to approximately the bottom center of the crotch area. Plastic caps 8 are provided on the outer ends 9 of the arms 6. The rear portions 6 are interconnected immediately beneath the arms 7 and at the bottom in the crotch area by conventional cable connectors 10 and 11, respectively.

Figure 7:
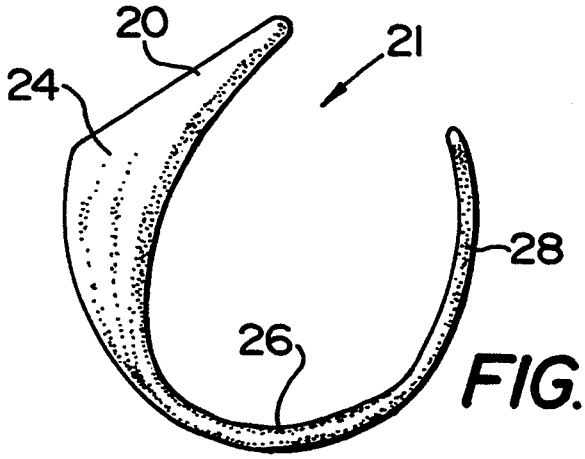
FIG. 7 is a side view of the bottom or briefs of FIGS. 4 to 6.

As best shown in FIG. 3, front portions 12 (in front of the connector 11) extend upwardly and outwardly (when viewed from the front or rear), i.e. diverge from the vertical planes occupied by the rear portions 6 to sharply rounded top corners 13. The corners 13 are located in a horizontal plane 14 above the longitudinal axes of the rear arms 7. The upper ends of the front portions 12 include arms 15 extending downwardly and inwardly from the corners 13 to vertical planes occupied by the rear portions 6 of the wire members. As best shown in FIG. 2, the arms 15 are inclined outwardly from the plane of the main body of the front portions 12 to allow for the curvature of the abdomen of the wearer. Short vertical stems or ends 16 are provided on the arms 15. The ends 16 are interconnected by a connector 17, which is similar to the connectors 10 and 11. A plastic cap 18 is provided on the bottom of the ends 16. The connectors 10, 11 and 17 are all defined by a strip of metal which is bent to form two parallel cylindrical tubes for receiving the wire members 2 and 3. While the connectors 10 and 11 firmly engage the frame members 2 and 3, the connector 17 only loosely engages the ends 16. Thus, the ends 16 can be rotated in the connector 17 as illustrated schematically by arrows 19 in FIG. 7, and the arms 15 can flex outwardly as shown in phantom outline in FIG. 2, whereby the front of the frame can conform to the shape of the tummy of a wearer. When the arms 15 flex outwardly, the ends 16 rotate, and the corners 13 move transversely of the frame towards each other while remaining in the same vertical plane.

With reference to FIGS. 4 to 9, when the wire frame 1 is covered with a fabric 20 or another flexible material, a finished bikini bottom or briefs generally indicated at 21 is the result. Covering of the frame 1 is effected by forming of a fabric tube or sock (not shown) which is pulled over the frame, folded over and sewn at the open end thereof. Obviously, in some areas the sock will be substantially narrower than the frame 1. Accordingly, it is necessary to deform the frame during application of the sock. The use of the loose connector 18 permits such deformation without substantially bending of the wires defining the frame. Following application of the sock, the frame 1 can be readily twisted to its original shape merely by rotating the ends 17 in the connector 18.

The briefs 21 include a generally triangular front panel 24 with a top edge 25 defining a V-shaped depression. The front panel 24 tapers downwardly to a narrow generally rectangular strip 26 which extends beneath the crotch of the wearer to a rear panel 28. The rear panel 28 is generally triangular with a straight top edge 29. The top edge of the front panel 24, i.e. the V-shaped depression 25 is located on the rectus abdominous muscle of the wearer. The top edge 29 of the rear panel 28 is located in the sacral area of the wearer, and specifically in the area of the lowest vertebra or sacrum of the wearer. With this structure, i.e. with the long top front and top rear edges, the pressure on the body of the wearer is spread out over a relatively large area of the body. The use of a wire frame extending around the entire periphery of the finished product maintains the structural integrity of the bikini bottom or briefs. Moreover, the use of the loose connector 18, ensures that the front panel 24 conforms reasonably closely to the shape of the abdomen of the wearer, i.e. the ends 17 of the frame 1 can rotate better to accommodate a round tummy. However, in spite of the utilitarian aspects of the frame, namely integrity of the structure in use, flexibility to conform to tummy shapes and load distribution, the finished product is aesthetically pleasing.

It will be appreciated that the two lengths of wire used from the frame can be replaced by a single length of wire shaped and bent to form the triangular front and rear panels. Connectors would still be used to hold the straight sides of the rear portion of the frame together, and the free ends of the wires would form the outer ends of the T-shaped top rear of the frame. The use of two separate lengths of wire is preferred for strength and ease of manufacture, assembly being a relatively simple operation.

We claim:

1. A frame for a bikini bottom or briefs comprising a pair of resilient wire members, one said wire member being the mirror image of the other said wire member, each said wire member defining a major portion of an oval of sufficient length to extend around the crotch of a wearer between an approximately V-shaped line on the rectus abdominous muscle in the front and the sacrum in the rear of the wearer, each said member including a rectilinear rear portion for extending downwardly from the top rear of the frame to approximately the bottom center of the crotch area, an outwardly extending rear arm at the top of the rear portion, and a front portion including a side flaring outwardly from the vertical plane of said rectilinear rear portion to a top end and a front arm extending downwardly and inwardly from said top end to said vertical plane; and connector means for interconnecting said frame members to define a T-shaped rear and a generally triangular front, said front having a generally V-shaped depression in the top thereof, said connector means including a first connector pivotally interconnecting the front portions of said frame members, whereby said front of the frame is readily deformed to facilitate mounting of a cover on the frame and to permit the front to conform to the area and shape of the rectus abdominous muscle of the wearer.

2. A frame according to claim 1, wherein said front portion of each said member includes vertical stem means on the inner end of said front arm for receiving said first connector, and said first connector comprises a cable connector having cylindrical loops retaining said vertical stem means to prevent separation thereof while permitting rotation of the stem means in the loops.

3. A frame according to claim 2, wherein said front portion extends upwardly a greater distance than said rear portion of said frame member in the use position.

4. A frame according to claim 3, wherein said front arm is inclined outwardly from the plane of the remainder of said front portion.

5. A frame according to claim 4, including second connector means for firmly interconnecting said frame means at the top rear immediately beneath the rear arms, and a third connector means for firmly interconnecting said frame means at the bottom center in the crotch area.

6. A bikini bottom or briefs comprising the frame of claim 1 in combination with a flexible cover, the bottom or briefs including a triangular rear panel with a straight top edge; a narrow rectangular strip in the crotch area; and a triangular front panel of greater length than the rear panel, said front panel having a V-shaped top edge.

* * * * *